United States Patent [19]

Dawson et al.

[11] Patent Number: 4,874,538

[45] Date of Patent: Oct. 17, 1989

[54] TOILET SOAP BAR COMPOSITIONS CONTAINING WATER SOLUBLE POLYMERS

[75] Inventors: Geoffrey G. Dawson, Ponteland; Michael K. Williams, Wokingham, both of England

[73] Assignee: The Procter & Gamble Company, Cincinnati, Ohio

[21] Appl. No.: 922,366

[22] Filed: Oct. 23, 1986

[30] Foreign Application Priority Data

Oct. 29, 1985 [GB] United Kingdom ..... 8526647
Mar. 13, 1986 [GB] United Kingdom ..... 8606239

[51] Int. Cl.[4] ..... C11D 9/26; C11D 9/30; C11D 17/00

[52] U.S. Cl. ..... 252/117; 252/108; 252/132; 252/121; 252/DIG. 2; 252/DIG. 16

[58] Field of Search ..... 252/108, 117, 121, 132, 252/DIG. 16, DIG. 2

[56] References Cited

U.S. PATENT DOCUMENTS

| | | | |
|---|---|---|---|
| 2,686,761 | 8/1954 | Ferguson et al. | 252/109 |
| 2,774,735 | 12/1956 | Becher | 252/117 |
| 3,155,624 | 11/1964 | Kelly | 252/122 |
| 3,275,561 | 9/1966 | Pye et al. | 252/110 |
| 3,278,444 | 10/1966 | McDonald | 252/121 |
| 3,489,686 | 1/1970 | Parran | 252/106 |
| 3,598,746 | 8/1971 | Kaniecki et al. | 252/122 |
| 3,723,325 | 3/1973 | Parran | 252/106 |
| 3,814,698 | 6/1974 | Ferrara et al. | 252/370 |
| 3,926,828 | 12/1975 | O'Neill et al. | 252/117 |
| 3,969,259 | 7/1976 | Lages | 252/107 |
| 4,141,947 | 2/1979 | Fischer et al. | 264/75 |
| 4,165,293 | 8/1979 | Gordon | 252/118 |
| 4,169,066 | 9/1979 | Joshi | 252/132 |
| 4,169,067 | 9/1979 | Joshi | 252/132 |
| 4,201,743 | 5/1980 | Perla et al. | 264/148 |
| 4,256,600 | 3/1981 | Lewis et al. | 252/132 |
| 4,265,778 | 5/1981 | Sonenstein | 252/117 |
| 4,285,826 | 8/1981 | Bertozzi et al. | 252/117 |
| 4,297,230 | 10/1981 | Rasser | 252/117 |
| 4,673,525 | 6/1987 | Small et al. | 252/132 |
| 4,678,593 | 7/1987 | Ridley | 252/131 |

FOREIGN PATENT DOCUMENTS

| | | |
|---|---|---|
| 186148 | 7/1986 | European Pat. Off. . |
| 20186148 | 7/1986 | European Pat. Off. . |
| 167700 | 10/1983 | Japan . |
| 723361 | 2/1955 | United Kingdom . |
| 723362 | 2/1955 | United Kingdom . |
| 1041934 | 9/1966 | United Kingdom . |
| 2001098A | 1/1979 | United Kingdom . |
| 2002807A | 2/1979 | United Kingdom . |
| 1573529 | 8/1980 | United Kingdom . |

OTHER PUBLICATIONS

Chemical Abstracts, vol. 101, No. 2, Jul. 1984, p. 101, Abstract No. 9140g, Columbus Ohio, U.S.; JP-A-58 167 699, (Shiseido Co., Ltd.) 3/10/83, Abstract only.

Chemical Abstracts, vol. 100, No. 12, Mar. 1984, p. 108, Abstract No. 87682d, Columbus, Ohio, U.S.; & JP-A-58 167 700, (Shiseido Co., Ltd.), 3/10/83, Abstract only.

Chemical Abstract, vol. 99, No. 20, Nov. 1983, p. 99, Abstract #160342k, Columbus Ohio, U.S.; & JP-A-58 53 999, (Kongo K.K.) 3/3/83, Abstract only.

Chemical Abstracts, vol. 98, No. 4, Jan. 1983, p. 98, Abstract #18478v, Columbus, Ohio, U.S.; JP-A-57 105 500, (Pola Chemical Industries, Inc.), 3/6/82, Abstract only.

*Primary Examiner*—Prince E. Willis

*Attorney, Agent, or Firm*—Robert B. Aylor; Leonard Williamson; Richard C. Witte

[57] ABSTRACT

Toilet compositions in beta-phase bar form comprising 45% to 95% $C_{8-24}$ fatty acid soap, 0% to 45% synthetic surfactant, and 0.01% to 5% of a water-soluble polymer. The compositions have improved lathering characteristics with excellent transparency/translucency.

10 Claims, No Drawings

TOILET SOAP BAR COMPOSITIONS CONTAINING WATER SOLUBLE POLYMERS

TECHNICAL FIELD

This invention relates to toilet soap bar compositions in the form of bars, tablets, sticks and the like. In particular, it relates to toilet compositions in at least part beta-phase form having improved lathering characteristics.

BACKGROUND

A wide variety of soap bar compositions and manufacturing processes are known in the art. Commonly, soap bar compositions for toiletry purposes are milled soaps of low moisture content (from about 5% to about 18% water) based on a mixture of tallow and coconut oil feedstocks. Bars having milled soap characteristics can also be prepared from soap of a high moisture content, as described for example in US-A-2,686,761 and US-A-2,970,116 by mechanically working the soap at a temperature of from about 80° F. to 125° F. and by using an appropriate fat feedstock. Such a process has two main advantages; firstly, it is relatively energy-efficient in that less drying of the neat-kettle soap is required; and secondly, it produces soap bars having desirable translucency or transparency as a result of beta-phase soap formation.

From the consumer acceptance viewpoint, of course, the lathering and mildness characteristics of a toilet bar composition are highly important and there is a continuing need to improve these areas of performance. Traditionally, lather enhancement has been achieved in two ways. Firstly, shorter chain fatty acid soaps such as coconut soaps are known to produce a much richer lather than longer chain fatty acid soaps such as those based on tallow and it is therefore common practice in toilet bar manufacture to add up to 50% coconut soap to the tallow fat feedstock. Secondly, superfatting agents such as coconut fatty acid also improve the volume and richness of the lather when added to toilet bars in levels of up to about 10%. At higher levels, however, coconut soaps increasingly have a detrimental effect on bar mildness while fatty acids can produce undesirable softening of the bar. Moreover, coconut soaps and fatty acids are both expensive commodities and it would therefore be desirable to achieve improvements in lathering without recourse to high levels of these ingredients.

In the case of beta-phase soaps, moreover, there is a more fundamental difficulty in achieving high lathering. Fat feedstocks which are relatively rich in shorter chain (less than 16 carbon atoms) saturated fatty acids inhibit the formation of beta-phase soap and are therefore unsuitable for making transparent or translucent soap bars. In a similar way, beta-phase soap formation is also inhibited by the addition of free fatty acid superfatting agents in levels above about 1%–2%. For all these reasons, therefore, it has not been possible hitherto to achieve significant improvements in the lathering characteristics of beta-phase soaps.

It has now been discovered that the addition of defined polymer materials to beta-phase soap bars has a beneficial effect on bar lathering (volume/richness) characteristics, both in soft and hard water conditions and than unexpectedly, the lathering improvement is achieved without detriment to beta-phase soap formation and without impairing transparency or translucency. The skin-feel and mildness characteristics of the bar are also significantly enhanced by use of the additives.

SUMMARY OF THE INVENTION

Accordingly, the present invention provides a beta-phase toilet bar composition comprising:

(a) from about 45% to about 95% by weight of soluble alkali metal soap of $C_8$–$C_{24}$ fatty acids, (b) from about 0% to about 45% of a synthetic surfactant, and (c) from about 0.01% to about 5% of a water-soluble polymer.

As used herein, the term toilet bar includes both conventional soap bar compositions and also mixed soap/-synthetic bar compositions. The compositions contain from about 45% to about 95% of soluble alkali metal soap of $C_8$–$C_{24}$, preferably $C_{10}$–$C_{20}$ fatty acids and from 0% to 45% of a synthetic sufactant, preferably an anionic or amphoteric surfactant. In highly preferred compositions, the soap component constitutes from about 55% to about 88% and the synthetic surfactant from about 0% to about 35% by weight of the composition. Especially preferred are milled toilet bar compositions which are essentially unbuilt (i.e. contains less than about 5% of a water-soluble surfactancy builder).

All percentages and ratios herein are by weight, unless otherwise specified.

Fatty acid soaps suitable for use herein can be obtained from natural sources such as, for instance, plant or animal esters (e.g., palm oil, coconut oil, babassu oil, soybean oil, castor oil, tallow, whale or fish oils, grease, lard, and mixtures thereof). The fatty acid soaps can also be synthetically prepared (e.g., by the oxidation of petroleum, or by the hydrogenation of carbon monoxide by the Fischer-Tropsch process). Resin acids, such as those present in tall oil, may be used. Naphthenic acids are also suitable.

Sodium and potassium soaps can be made by direct saponification of the fats and oils or by the neutralization of the free fatty acids which are prepared in a separate manufacturing process. Particularly useful in the present invention are the sodium and potassium salts of mixtures of fatty acids derived from coconut oil and tallow, i.e., sodium and potassium tallow and coconut soaps.

Tallow fatty acids can be derived from various animal sources and generally comprise about 1% to 8% myristic acid, about 21% to 32% palmitic acid, about 14% to 31% stearic acid, about 0% to 4% palmitoleic acid, about 36% to 50% oleic acid and about 0% to 5% linoleic acid. A typical distribution is 2.5% myristic acid, 29% palmitic acid, 23% stearic acid, 2% palmitoleic acid, 41.5% oleic acid, and 3% linoleic acid.

Coconut oil refers to fatty acid mixtures having an approximate carbon chain length distribution of: 8% $C_8$, 7% $C_{10}$, 48% $C_{12}$, 17% $C_{14}$, 8% $C_{16}$, 2% $C_{18}$, 7% oleic and 2% linoleic acids (the first six fatty acids listed being saturated). Other sources having similar carbon chain length distributions, such as palm kernel oil and babassu kernel oil, are included within the term coconut oil. Coconut oil fatty acids ordinarily have a sufficiently low content of unsaturated fatty acids to have satisfactory keeping qualities without further treatment. Generally, however, fatty acids are hydrogenated to decrease the amount of unsaturation (especially polyunsaturation) of the fatty acid mixture.

The compositions herein generally take the form of a toilet bar wherein the soap is at least partially in beta-phase form. Beta-phase soap crystals have a smaller lattice dimension than delta and omega soap phases and are associated with a typifying 6.35 cm X-ray diffraction ring. The relative amount of beta-phase in the toilet bars of the invention can be determined by comparing the relative intensities of the beta, delta and omega diffraction rings against those of known standard soap phase mixtures (see US-A-2686761). In preferred embodiments, therefore, the soap is preferably at least about 20%, more preferably at least about 50% and especially at least about 70% in the beta-phase form. In highly preferred compositions, the bar is a milled toilet bar and is transparent or translucent, preferably having a translucency voltage (see US-A-2970116 and EP-A-0014502) of less than about 110, preferably less than about 60, more preferably less than about 45. It is a feature of the present invention that the polymeric materials can be incorporated in such bars without substantially impairing transparency.

The soap fat stock for making bars which are predominantly beta-phase is of some importance and desirably the fat stock comprises no more than about 40% thereof of saturated fatty acids of less than 16 carbon atoms and at least about 20% thereof of saturated fatty acids of from 16 to 22 carbon atoms. In preferred compositions, the fat stock comprises no more than about 30% of the shorter chain saturated fatty acids and at least about 70% of the longer chain saturated fatty acids. The moisture content of the finished beta-phase bar is generally from about 15% to about 26% by weight, preferably from about 20% to about 24%.

Preferred compositions herein also contain a synthetic surfactant. The surfactant is valuable for improving formulation characteristics in the area of scum formation under hard water usage conditions. It is a feature of the invention that both the synthetic surfactant and polymer can be incorporated in the compositions of the invention without detriment to beta phase formation and bar transluency. Preferred from the viewpoint of scum dispersion are synthetic surfactants belonging to the anionic and amphoteric surfactant classes. The level of surfactant is preferably from about 0.5% to about 15%, more preferably from about 1% to about 8%.

Suitable anionic and amphoteric surfactants for use herein include alkyl glyceryl ether sulfonate (AGS), anionic acyl sarcosinates, methyl acyl taurates, N-acyl glutamates, alkyl glucosides, acyl isethionates, alkyl sulfosuccinate, alkyl phosphate esters, ethoxylated alkyl phosphate esters, trideceth sulfates, methyl glucose esters, protein condensates, alkyl sulfates, ethoxylated alkyl sulfates, and alkyl amine oxides, betaines, sultaines, and mixtures thereof. The above surfactants are generally based on $C_8$–$C_{24}$, preferably $C_{10}$–$C_{18}$ alkyl and acyl moities. Of the above surfactants, highly preferred are $C_{10-18}$ alkyl glyceryl ether sulfonates, $C_{10-18}$ alkyl sulfates, ethoxylated $C_{10-18}$ alkyl sulfates having an average of from 1 to 6 moles of ethylene oxide per mole of surfactant, and $C_{10-18}$ alkyl betaines.

A further essential component of the beta-phase toilet bar compositions is a polymer. The polymer should be soluble or dispersible in water to a level of at least 1% by weight- preferably at least 5% by weight at 25° C. Suitable polymers are high molecular weight materials (mass-average molecular weight determined, for instance, by light scattering, being geneally from about 20,000 to about 5,000,000, preferably from about 50,000 to about 4,000,000, more preferably from 500,000 to about 3,000,000) and preferably have a thickening ability such that a 1% dispersion of the polymer in water at 20° C. exceeds about 1 Pa.s (10 poise) at a shear rate of $10^{-2}$ $sec^{-1}$.

Polymers useful in the present invention are the cationic, nonionic, amphoteric and anionic polymers useful in the cosmetic field. Preferred are cationic and nonionic resins and mixtures thereof. Highly preferred are the cationic resins. The level of polymer is from about 0.01% to about 5%, preferably from about 0.1% to about 2% by weight. In preferred embodiments, the polymer forms a water-soluble 'poly-salt' complex with the anionic soap/surfactant components.

Cationic polymers suitable in the present invention are selected from cationic polysaccharides, homopolymers of dimethyldiallyl ammonium chloride, copolymers of dimethyldiallyl ammonium chloride and acrylamide, cationic homopolymers and copolymers derived from acrylic acid and/or methacrylic acid, polyalkylene imines and ethoxy polyalkylene imines, and mixtures thereof. Of these, preferred cationic polymers are cationic guar gums, for example hydroxyproxytrimethylammonium guar gum, quaternized cellulose ethers, quaternized vinylpyrrolidone acrylate or methacrylate copolymers of aminoalcohol, copolymers of dimethyldiallyl ammonium cloride and acrylamide, homopolymers of dimethyldiallyl ammonium chloride, and mixtures thereof. A highly preferred cationic polymer herein is a copolymer of dimethyldiallyl ammonium chloride and acrylamide.

By way of exemplification, cationic polymers preferred for use herein include hydroxypropyl trimethyl ammonium guar gum (d.s. of from 0.11 to 0.22) available commercially under the trade names Jaguar C-17(RTM), and also Jaguar C-16(RTM), which contains hydroxypropyl substituents (d.s. of from 0.8–1.1) in addition to the above-specified cationic groups, quaternized cellulose ethers available commercially under the trade names Ucare Polymer JR and Celquat, homopolymers of dimethyldiallyl ammonium chloride available commercially under the trade name Merquat 100, copolymers of dimethyl aminoethylmethacrylate and acrylamide, copolymers of dimethyldiallyl ammonium chloride and acrylamide available copolymers commercially under the trade names Merquat 550 and Merquat S and quaternized vinyl pyrrolidone acrylate or methocrylate copolymers of amino alcohol available commercially under the trade name Gafquat.

Nonionic polymers suitable for use herein are selected from guar gum, hydroxypropyl guar gum, methyl cellulose, methyl hydroxypropyl cellulose, hydroxypropyl cellulose, locust bean gum, starch, starcy amylose, hydroxyethylamylose and polyoxyethylene and mixtures thereof. Highly preferred nonionic polymers are guar gum and hydroxypropyl guar gum having a degree of substitution of from about 0.3 to about 1.2, for example, Jaguar (RTM) HP-60 from Meyhall Chemical Ltd in which the degree of substitution is about 0.6.

In addition to the components described above, the toilet bars of the present invention can contain a wide variety of optional materials. These optional materials include, for example, skin conditioning components, processing aids, anti-bacterial agents and sanitizers, dyes, perfumes and coloring agents.

Materials to facilitate the preparation of the instant toilet bars can also be present. Thus, glycerine, for example, can be added to the crutcher or amalgamator in order to facilitate processing. Glycerine, if present, generally comprises from about 0.2% to about 10% by weight of the finished bar. Additionally, emulsifiers such as polyglycerol esters (e.g. polyglycerol monostearate), proylene glycol esters and other chemically stable nonionic materials may be added to the bars to help solubilize various components, particularly skin conditioning agents, such as sorbitan esters. Alkali metal citrates are also valuable herein as plasticisers.

Conventional anti-bacterial agents and sanitizers can be added to the bars of the present invention. Typical anti-bacterial sanitizers include 3,4-di- and 3',4',5-tribromosalicyl-anilides; 4,4'-dichloro-3-(trifluoromethyl) carbanalide; 3,4,4'-tri-chlorocarbanalide and mixtures of these materials. Use of these materials in soap bars is described in more detail in US-A-3,256,200. If present, anti-bacterial agents and sanitizers generally comprise from about 0.5% to about 4% by weight of the finished bar.

The bars of the present invention can optionally contain various emollients and skin conditioning agents. Materials of this type include, for example, sorbitan esters, such as those described in US-A-3,988,255, lanolin, cold cream, mineral oil, isopropyl myristate, and similar materials. If present, such emollients and skin conditioning agents generally comprise from about 0.5% to about 5% by weight of the bar.

The toilet bars herein can also contain an electrolyte as described in US-A-2686761 and EP-A-14502. Suitable electrolytes include sodium chloride, potassium chloride, potassium carbonate, dipotassium monohydrogen orthophosphate, tetrasodium pyrophosphate, tetrapotassium pyrophosphate, sodium tripolyphosphate, potassium tripolyphosphate, trisodium orthophosphate, tripotassium orthophosphate, and sodium and/or potassium formates, citrates, acetates and tartrates, and mixtures of the above. The electrolyte level is from about 0.2% to about 4.5%.

The toilet bars of the invention can also contain free fatty acid, in addition to the neutralized fatty acids which form the actual soap component. Free fatty acids are especially valuable as plasticizers. Without the free fatty acids, some bars have a greater tendency to form wet cracks. The free fatty acid content should be restricted to less than about 1%–2% by weight, however.

Acidic materials can be added to the bar to control free alkalinity. A suitable example is citric acid added at a level of about 0.1% to about 3%.

Another desirable ingredient of the compositions of the invention is a pearlescent material such as mica, titanium-dioxide coated mica, natural fish silver or heavy metal salts such as bismuth oxychloride. It is a feature of the invention that the polymers described herein can be incorporated in such compositions without detriment to the development of pearlescence.

The toilet bars can also contain any of the conventional perfumes, dyes and coloring agents generally utilized in commercially-marketed bars to improve the characteristics of such products. If present, such perfumes, dyes and coloring agents comprise from about 0.2% to about 5% by weight of the bar.

The compositions of the invention are prepared in conventional manner, either from neat kettle soap or from saponified touch-hardened fatty acid blends. In a typical process, neat kettle soap containing from about 28% to about 34%, preferably from about 30% to about 32% moisture is dried, preferablyby Mazzoni spray drying, to a moisture content of from about 15% to about 26%, preferably from about 19% to about 25%, more preferably from about 21% to about 23% by weight of the soap mix and the dried soap is mechanically worked at an elevated temperature, for example in an amalgamator or over milling rolls, until the temperature is raised into the range from about 27° C. to about 51° C., prefrably from about 37° C. to about 43° C., more preferably from about 39° C. to about 41° C. Thereafter, the soap mass is plodded into bar form.

In the examples which follow, the following abbreviations have been made.

P1 Merquat (RTM) 550–Copolymer of acrylamide and dimethyldiallyl ammonium chloride, weight average 6 mol.wt $2.5\times10^6$ (8% aq. solution).

P2 Polymer JR-400–hydroxyethylcellulose reacted with epichlorohydrin and quaternized with trimethylamine, mol.wt $4\times10$.

P3 Jaquar HP-60 hydroxypropyl guar gum.

AGS Sodium $C_{12-14}$ alkylglyceryl ether sulfonate $AE_3S$ Sodium $C_{12-14}$ alkyl $(EO)_3$ sulfonate

EXAMPLES I TO VI

Soap bar compositions according to the invention are prepared as described above in which sodium tallow/coconut (80/20) kettle soap is mixed with all remaining ingredients, apart from perfume, dye, $TiO_2$ and mica, the mixture is dried in a Mazzoni spray dryer, the dried soap mixture is admixed with the remaining components in an amalgamator, then milled at about 40° C. to optimize beta-phase soap formation, and finally plodded into bar form. The compositions are as follows:

| | I | II | III | IV | V | VI |
|---|---|---|---|---|---|---|
| Sodium tallow/coconut (80/20) soap (anhydrous) | 60 | 70.3 | 66.6 | 68.5 | 69.8 | 61.5 |
| Potassium cocoate soap | 4 | — | — | 3 | — | 4 |
| Tripotassium citrate monohydrate | 2.5 | 2 | 2.5 | 1.5 | — | 3 |
| Sodium chloride | 0.4 | 0.8 | 0.4 | 0.3 | 0.6 | 0.5 |
| Glycerine | 4 | 7 | 4 | — | 5 | 5 |
| EDTA | 0.2 | 0.3 | 0.2 | 0.1 | 0.2 | 0.1 |
| Lauric Acid | 0.8 | 0.2 | 0.8 | 0.5 | 0.6 | 1 |
| $TiO_2$ coated mica | 0.1 | 0.1 | 0.1 | 0.1 | 0.1 | — |
| $TiO_2$ — | — | — | — | — | 0.2 | |
| Perfume and dye | 2 | 1.3 | 1.4 | 1 | 2.2 | 1.9 |
| P1 | 5 | 2 | 3 | — | 4 | — |
| P3 | — | — | 0.5 | 1 | 0.5 | 1 |
| Moisture | | | —100— | | | |

The above compositions are beta-phase toilet soaps having improved lathering (volume/richness) characteristics, both in soft and hard water, as well as excellent transparency or translucency, smear, cleansing performance, and enhanced skin-feel characteristics.

EXAMPLES VII TO IX

Soap bar compositions according to the invention are prepared as follows. A sodium tallow/coconut (80/20) kettle soap is mixed with all remaining ingredients, apart from polymer, perfume, dye, $TiO_2$ and mica, the mixture is dried in a Mazzoni spray dryer, the dried soap mixture is admixed with the remaining components in an amalgamator, the polymer or polymers being added in dry form, the mixture is then milled at about 40° C. to optimize beta-phase soap formation, and finally plodded into bar form. The compositions are as follows:

| | VII | VIII | IX |
|---|---|---|---|
| Sodium tallow/ coconut (80/20) soap (anhydrous) | 61 | 54.1 | 59.5 |
| Potassium cocoate soap | 4 | 4 | 4 |
| AGS | — | 10 | — |
| Tripotassium citrate monohydrate | 2.5 | 2.5 | 2.5 |
| $AE_3S$ | 4 | — | 4 |
| Sodium chloride | 0.4 | 0.8 | 0.4 |
| Glycerine | 8 | 8 | 4 |
| EDTA | 0.2 | 0.3 | 0.2 |
| Lauric Acid | 0.8 | 0.2 | 0.8 |
| $TiO_2$ coated mica | 0.1 | 0.1 | 0.1 |
| Perfume | — | — | 1.5 |
| P1 | — | 1 | — |
| P2 | 1 | 1 | 1 |
| Moisture | 18 | 18 | 22 |

The above compositions are beta-phase toilet soaps having improved lathering (volume/richness) characteristics, both in soft and hard water, as well as excellent transparency or translucency, smear, cleansing performance, and enhanced skin-feel characteristics.

What is claimed is:

1. A beta-phase milled transparent or translucent toilet bar composition comprising:

(a) from about 45% to about 95% by weight of soluble alkali metal soap of $C_8$–$C_{24}$ fatty acids, (b) from about 0% to about 45% of synthetic surfactant selected from the group consisting of anionic surfactant, amphoteric surfactant, and mixtures thereof, and (c) from about 0.01% to about 5% of water-soluble polymer having a molecular weight of from about 20,000 to about 5,000,000 selected from the group consisting of (1) cationic polymer selected from the group consisting of cationic guar gums, quaternized cellulose ethers, quaternized vinylpyrrolidone acrylate or methacrylate copolymers of aminoalcohol, copolymers of dimethyldiallyl ammonium chloride and acrylamide, homopolymers of dimethyldiallyl ammonium chloride, and mixtures thereof;

(2) nonionic polymers selected from the group consisting of guar gum and hydroxypropyl guar gum having a degree of substitution of from about 0.3 to about 1.2; and (3) mixtures thereof;

wherin at least about 50% by weight of the soap is in the beta-phase.

2. A composition according to claim 1 wherein at least about 70% by weight of the soap is in the beta-phase.

3. A composition according to claim 1 comprising soap of a fat stock no more than about 40% of which are saturated fatty acids of less than 16 carbon atoms and at least about 20% of which are saturated fatty acids of from 16 to 22 carbon atoms.

4. A composition according to claim 1 having a water content of from about 15% to about 26% by weight.

5. A composition according to claim 1 wherein the polymer is a cationic polymer.

6. A composition according to claim 5 wherein the cationic polymer is selected from copolymers of dimethyldiallyl ammonium chloride and acrylamide.

7. A composition according to claim 1 wherein the polymer is a nonionic polymer.

8. A composition according to claim 1 comprising from 0.5% to 15% of synthetic surfactant selected from the group consisting of alkyl glyceryl ether sulfonate (AGS), anionic acyl sarcosinates, methyl acryl taurates, N-acyl glutamates, alkyl glucosides, acyl isethionates, alkyl sulfosuccinate, alkyl phosphate esters, ethoxylated alkyl phosphate esters, alkyl sulfates, ethoxylated alkyl sulfates, and alkyl amine oxides, betaines, sultaines, and mixtures thereof.

9. A composition according to claim 8 comprising from 1% to 8% of synthetic surfactant.

10. A composition according to claim 9 wherein the synthetic surfactant is selected from the group consisting of $C_{10-18}$ alkyl glyceryl ether sulfonates, $C_{10-18}$ alkyl sulfates, ethoxylated $C_{10}$–$C_{18}$ alkyl sulfates having an average of from 1 to 6 moles of ethylene oxide per mole of surfactant, and $C_{10-18}$ alkyl betaines.

* * * * *